US006637242B2

(12) United States Patent
Masters

(10) Patent No.: US 6,637,242 B2
(45) Date of Patent: Oct. 28, 2003

(54) HANDCUFF RESTRAINT STRAP

(76) Inventor: Scott A. Masters, 255 Turfview Dr., Solana Beach, CA (US) 92075

( * ) Notice: Subject to any disclaimer, the term of this patent is extended or adjusted under 35 U.S.C. 154(b) by 0 days.

(21) Appl. No.: 09/872,450

(22) Filed: Jun. 1, 2001

(65) Prior Publication Data

US 2002/0000109 A1 Jan. 3, 2002

Related U.S. Application Data

(60) Provisional application No. 60/209,102, filed on Jun. 2, 2000.

(51) Int. Cl.[7] ..... E05B 75/00
(52) U.S. Cl. ..... 70/16; 70/15; 70/17
(58) Field of Search ..... 70/15, 16, 17; 119/792, 793, 795; 16/114.1, 408, 409, 444, 445

(56) References Cited

U.S. PATENT DOCUMENTS

| | | | | |
|---|---|---|---|---|
| 136,419 | A | | 3/1873 | Craig et al. |
| 284,165 | A | | 9/1883 | Bean |
| 738,983 | A | | 9/1903 | Burdick |
| 1,477,777 | A | | 1/1923 | Shek |
| 1,803,280 | A | | 1/1931 | Stull et al. |
| 1,823,697 | A | | 9/1931 | Nenstiehl |
| 2,187,021 | A | * | 1/1940 | Everson ..... 119/792 |
| 2,398,948 | A | | 4/1946 | Martinez |
| 4,949,679 | A | * | 8/1990 | Wolfer ..... 128/878 |
| 5,345,947 | A | * | 9/1994 | Fisher ..... 128/878 |
| 5,443,155 | A | | 8/1995 | Robinson |
| 5,461,890 | A | * | 10/1995 | LeFavor ..... 70/16 |
| 5,555,751 | A | | 9/1996 | Strickland et al. |
| 5,593,159 | A | | 1/1997 | Otake |
| 5,613,381 | A | | 3/1997 | Savage |
| 5,680,781 | A | | 10/1997 | Bonds et al. |
| 5,687,593 | A | | 11/1997 | Cross |
| 5,711,255 | A | * | 1/1998 | Rudolph ..... 119/793 |
| 5,839,394 | A | * | 11/1998 | Dickison ..... 119/795 |
| 5,901,668 | A | * | 5/1999 | Goodger, Sr. ..... 119/795 |
| 6,089,193 | A | * | 7/2000 | Paglericcio ..... 119/795 |
| 6,360,747 | B1 | * | 3/2002 | Velarde et al. ..... 128/869 |

* cited by examiner

*Primary Examiner*—Anthony Knight
*Assistant Examiner*—Michael J. Kyle
(74) *Attorney, Agent, or Firm*—Knobbe Martens Olson & Bear LLP

(57) ABSTRACT

A handcuff restraint strap is disclosed herein. The strap is made of a substantially soft, flexible, and strong material, such that it is comfortable to hold, and will withstand the forces applied while an officer holds and controls a suspect. The strap mounts to the center chain on the handcuffs and provides a handle for an officer to easily manage a handcuffed individual.

10 Claims, 2 Drawing Sheets

HANDCUFF RESTRAINT STRAP

RELATED APPLICATIONS

This application claims priority to Provisional Application No. 60/209,102, filed on Jun. 2, 2000.

FIELD OF THE INVENTION

This invention relates to a restraint device that works in conjunction with conventional handcuffs. More specifically, this invention relates to a restraint strap that is used in conjunction with conventional handcuffs to provide a handle for restraining a handcuffed individual.

BACKGROUND

When a police officer or other security personal attempts to detain a suspect, the officer normally handcuffs the suspect. This process is one of the most dangerous procedures for a police officer largely due to the possibility of a prisoner attempting to escape. If the suspect attempts to escape as they are being handcuffed, the police officer can be hurt by trying to restrain the suspect by grabbing the handcuff or handcuff chain, or the suspect may escape if the officer fails to hold onto the handcuff. Thus, what is needed in the art is a mechanism for safely restraining a suspect during the handcuff process.

SUMMARY

One embodiment of the invention is a restraint device that mounts a chain disposed between two handcuffs. The restraint device includes: a loop of material adapted to be gripped by a human hand; and a securing device associated with the loop of material, wherein the securing device separates the loop of material into a first gripping loop and a second mounting loop, and wherein the second mounting loop is adapted to securely mount to said chain.

Another embodiment of the invention is a pair of handcuffs and a restraint device that mounts a chain disposed between the handcuffs, wherein the restraint device includes: a loop of material adapted to be gripped by a human hand; and a securing device associated with the loop of material, wherein the securing device separates the loop of material into a first gripping loop and a second mounting loop, and wherein the second mounting loop is adapted to securely mount to said chain.

DETAILED DESCRIPTION

Embodiments of the invention relate to restraining straps that mount between a pair of handcuffs to provide a means for a law enforcement officer to restrain a suspect. In one embodiment, a restraining strap is slid over one handcuff and reversibly, yet securely mounts between each handcuff. The restraining strap thus provides a secure and comfortable grip for the officer to control and restrain a handcuffed suspect.

One embodiment of the restraining strap includes a flexible outer shell made of nylon, leather, neoprene, Kevlar or other flexible, yet durable, material. For example, one-inch wide tubular nylon webbing has been found to be suitable due to its tensile strength and smooth texture. As discussed below, the handcuff-mounting portion of the restraining strap can include a loop of material that fits over a handcuff chain and is secured to the chain by a securing band. The securing band prevents the handcuff strap from inadvertently sliding off the handcuff chain. In addition, in one embodiment, the handgrip portion of the restraining strap includes a cushioned hand-grip area that provides a soft surface for gripping with a hand.

In another embodiment of a restraining strap, the handgrip portion is in the shape of a loop that is connected to a single strap. The single strap is then attached between the handcuffs by, for example, tying a knot, using a snap or any other means for connecting the single strap to the handcuffs.

It should be realized that the hand-grip portion is not limited to only comprising a loop shaped piece of material. For example, the hand-grip portion can be in the shape of a "T" or any other shape that is easily gripped by a human hand.

In use, the police officer mounts the restraining strap to the chain that links the handcuffs. The restraining strap is preferably in the shape of a flexible loop and is adapted to fit inside the palm, or over the hand, of the officer. An officer may hold the handle of the restraining strap in the palm of their hand, or they may place the gripping loop of the strap over their hand. With the restraining strap mounted on the handcuffs and securely held, the officer may place the handcuffs on a suspect while maintaining a secure grip on the handcuffs. Thus if the suspect attempts to fight or escape with one or both handcuffs secured, the officer has a controlling grip on the strap attached to the handcuffs by which to restrain the suspect.

Figure 1:
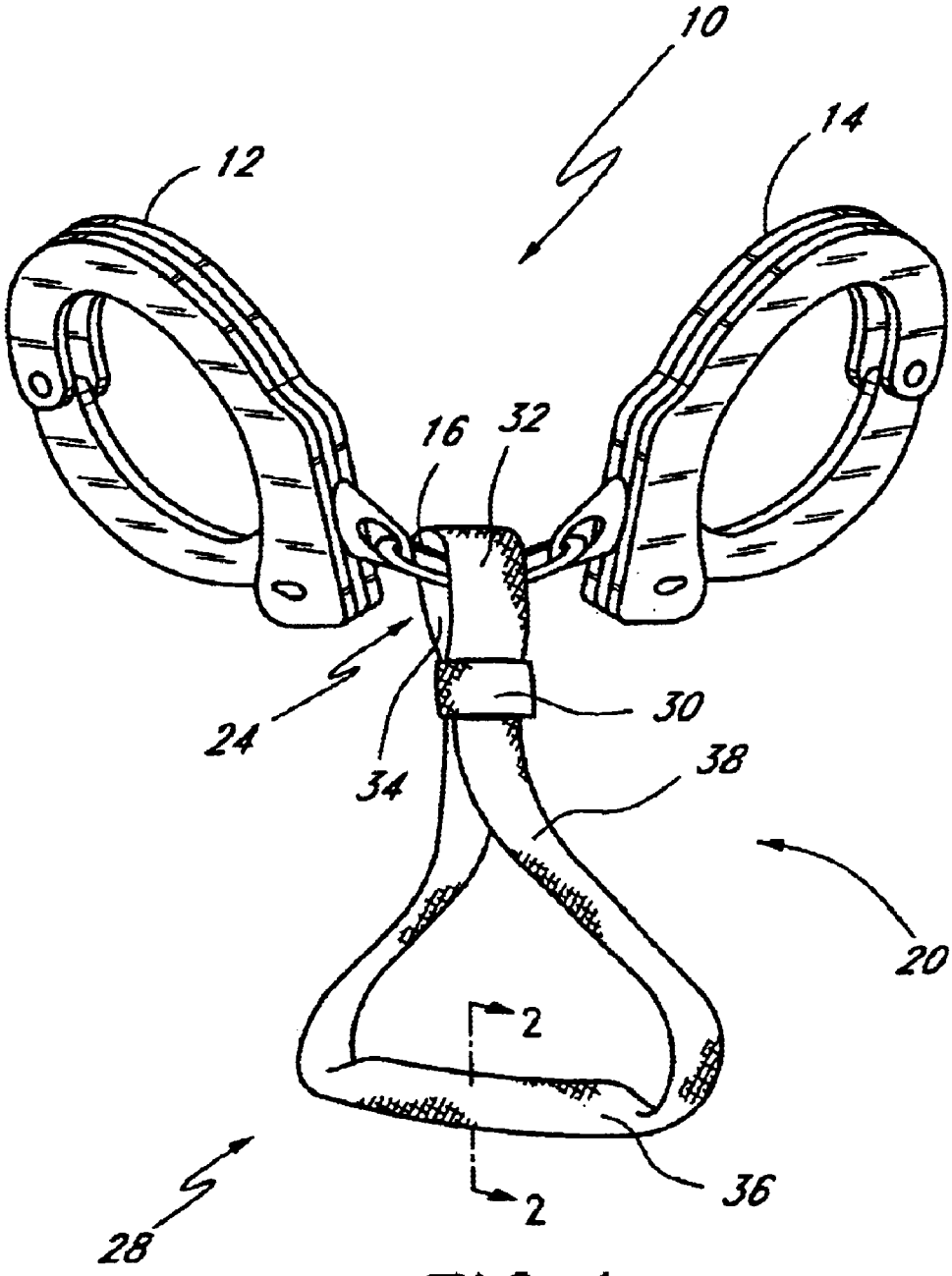
FIG. 1 is a perspective view illustrating a pair of handcuffs and one embodiment of a restraining strap.

FIG. 1 shows a typical pair of handcuffs 10, including a left handcuff 12 and right handcuff 14. Disposed between the right and left handcuffs is a chain 16 that prevents the right and left handcuffs 12, 14 from being separated. The particular design and materials of handcuffs are well known, and beyond the scope of the present description, thus they will not be discussed herein. For example, some handcuffs incorporate a hinge between each handcuff in place of the chain 16. Embodiments of the invention include restraining straps that mount to the such a hinge in addition to restraining straps that mount to the chain 16.

One embodiment of a handcuff restraining strap 20 is shown in FIG. 1. The handcuff restraining strap 20 is generally characterized by a mounting loop 24 and a gripping loop 28 separated by a retaining band 30, both of which are preferably adjustable in size. It should be noted that in this embodiment, the mounting loop 24 and gripping loop 28 are formed from a single loop of material.

The restraint strap 20 has a front portion 32 and a rear portion 34 integrally formed with at least the mounting loop 24 as shown. Preferably, the retaining band 30 fits snugly about the front and rear 32, 34 portions so that it is secured around the chain 16.

The handcuff restraining strap 20 is preferably made from a substantially flexible, but substantially strong material such that the restraining strap is comfortable to hold, yet has sufficient tensile strength so that it will not break under expected loads. The mounting loop 24 is preferably made of a material which will resist abrasion from contact with the chain 16.

The retaining band 30 may be made from any suitable material such that it will perform the functions described herein without abrading the material of the mounting loop 24. For example, the retaining band 30 may be made from a substantially flexible nylon, Kevlar®, or a substantially rigid metal. In one embodiment, the retaining band 30 is fixed to the front portion 32, leaving the rear portion 34 free to slide relative to the retaining band 30 and the front portion 32. Thus the size of the mounting loop may be increased or decreased by sliding the free, rear portion 34 in the appropriate direction relative to the retaining band 30.

For example, the size of the mounting loop 24 can be increased by sliding the rear portion 34 toward the mounting loop 24, thus decreasing the size of the gripping loop 28. This embodiment has the particular advantage that when the restraining strap 20 is disposed on a handcuff chain 16 as shown, and the handle 36 is pulled, the mounting loop 24 will tighten around the chain 16. Alternatively, the retaining band 30 may be disposed such that both front and rear portions 32, 34 may be free to slide relative to the retaining band 30.

It should also be realized that the means for mounting the restraining strap to the chain does not necessarily need to be a loop of material. For example, a strong snap or latch mechanism can be positioned within the restraining strap so that once the strap is slid over the chain, the latch or snap can be closed to secure the restraining strap to the handcuff chain. Any similar securing device for reversibly mounting the restraining strap to the handcuff chain is within the scope of the invention.

The gripping loop 28 preferably comprises a handle section 36. The handle section 36 is preferably sufficiently large to allow a user to comfortably and controllably grip the handcuff restraint strap 20. The material of the gripping loop 28 is preferably comfortable to hold and substantially flexible. The gripping loop 28 preferably comprises a larger diameter than the mounting loop 24. The gripping loop 28 may be gripped such that the user's fingers wrap around the handle section 36, or the user may slide their hand through the gripping loop 28, thus retaining the restraint strap 20 on the user's wrist.

Figure 2:
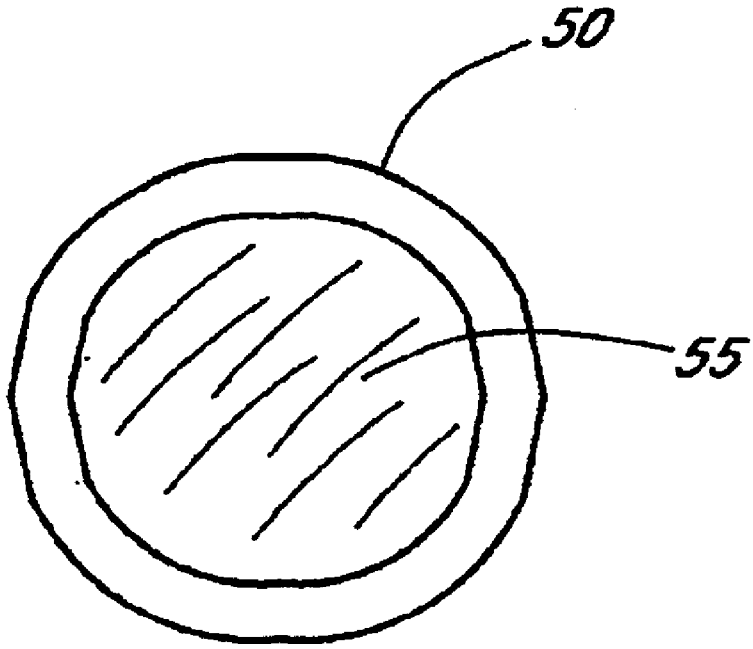
FIG. 2 is a cross-sectional view along the line 2—2 of FIG. 1.

FIG. 2 is a cross-sectional view of the restraining strap 20 taken across line 2—2 (FIG. 1). As indicated, the handle section 36 of the restraining strap includes, in one embodiment, an outer shell 50 made of a flexible material, such as neoprene, woven cloth, nylon, Kevlar, cotton, or other similar material. Placed within the interior of the outer shell 50 is, in one embodiment, a strong, thick material 55, such as rope, rubber, or polystyrene. The combination of the outer shell 50 and inner material 55 provides a gripable area due to its relatively large circumference. The handle section 36 may comprise a variety of materials such that it provides a comfortable handle for the user.

The use and assembly of a restraining strap 20 will now be described with reference to FIG. 1. In order to put the restraining strap 20 on the handcuff chain 16, the size of the mounting loop 24 of the restraining strap 20 is increased as much as possible, as discussed above. The mounting loop 24 is then slid over an open end of one of the handcuffs 12 or 14. Once the mounting loop 24 has been slid over the handcuff 12 or 14, the mounting loop is tightened across the chain 16 by sliding the rear portion 34 toward the gripping loop 28 through the retaining band 30. As can be imagined, the retaining band 30 provides a means for securing the restraining strap 20 to the chain 16 and thus the handcuffs 12 and 14.

In one embodiment, a handcuff restraint strap 20 may be made by taking a section of tubular nylon webbing, inserting a segment of rope into the space within the webbing and sliding it to a position substantially within the webbing. The material is then formed into a loop by securing the ends of the webbing together using any method known to those skilled in the art. For example, the ends may be glued, welded, bar-tacked, sewn, or stapled. A retaining band 30 is then preferably placed about the front and back portions 32, 34 as described above, and fixed to the front portion 32 if desired. The retaining band 30 is preferably placed about the restraining strap 20 at a position such that it covers and may reinforce the joint of the two ends of the restraining strap material 38.

In another embodiment, a handcuff restraint strap 20 may be made by taking a section of suitable material as described above, inserting it into a tubular handle material such as a section of rubber or latex tubing, then attaching the ends of the strap material by a method suitable for that material. A retaining band 30 is then preferably placed about the front and back portions 32, 34 of the restraining strap 20 as described above, and fixed to the front portion 32 if desired. The retaining band 30 is preferably placed about the restraining strap at a position such that it covers and may reinforce the joint of the two ends of the restraining strap material 38.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A restraint device that mounts between two handcuffs, comprising:

a hollow loop of material with an integrated gripping portion adapted to be gripped by a human hand, wherein the integrated gripping portion of the loop has a larger diameter than the remaining portion of the loop of material; and a slidably engaged retaining band configured to divide the loop of material into a gripping loop, comprising the integrated gripping portion, and a handcuff mounting loop, wherein the handcuff mounting loop is adapted to securely mount between the two handcuffs.

2. The device of claim 1, wherein the integrated gripping portion comprises a soft, tubular material disposed over tie gripping portion of the hollow loop of material.

3. The device of claim 1, wherein the integrated gripping portion comprises a soft material that is disposed within the hollow loop of material in the integrated gripping portion of the gripping loop.

4. The restraint device of claim 1, where in the restraint device mounts to a chain disposed between the handcuffs.

5. The restraint device of claim 1, wherein the retaining band is a band of flexible material.

6. In combination, a pair of handcuffs and a restraint device that mounts between a pair of handcuffs, wherein the restraint device comprises:

a loop of material adapted to be gripped by a human hand and comprising a substantially flexible material so as to provide a comfortable gripping portion for a human hand; and means for securing the restraint device to the pair of handcuffs and configured to separate the loop of material into a gripping lop and a mounting loop, wherein the mounting loop is slidably adjustable with respect to the means for securing so as to slidably engage the handcuffs, wherein the gripping loop comprises material of a larger diameter than the material of the mounting loop, and wherein the means for securing is adapted to securely mount the mounting loop to a chain disposed between the handcuffs.

7. The combination of claim 6, wherein the means for securing is a band of material.

8. The combination of claim 6, wherein the means for securing comprises a fastener or snap.

9. The combination of claim 6, wherein the gripping loop comprises additional gripping material disposed within the gripping portion of the gripping loop.

10. The combination of claim 6, wherein the gripping portion comprises a soft, tubular material that is disposed over the gripping loop.

* * * * *